United States Patent [19]

Joyce

[11] 4,034,768

[45] July 12, 1977

[54] NON FIBROUS CIGARETTE FILTER

[76] Inventor: Patrick J. Joyce, 103 Hubbard Avenue, Stamford, Conn. 06905

[21] Appl. No.: 577,344

[22] Filed: May 14, 1975

[51] Int. Cl.[2] ..... A24D 1/04

[52] U.S. Cl. ..... 131/269

[58] Field of Search ..... 131/261–269, 131/9, 10 R, 10.3, 10.5, 11; 260/326.8, 326.82, 326.9, 78 P, 78 SC, 326.81

[56] References Cited

U.S. PATENT DOCUMENTS

| | | | |
|---|---|---|---|
| 3,327,715 | 6/1967 | Azorlosa | 131/266 X |
| 3,538,920 | 11/1970 | Davis | 131/10 |
| 3,681,293 | 8/1972 | Jarovitzky | 260/78 P |
| 3,686,066 | 8/1972 | Peters | 260/78 P X |

*Primary Examiner*—Robert W. Michell
*Assistant Examiner*—V. Millin

[57] ABSTRACT

A novel cigarette filter comprised a porous sponge of non woven particles of a polymer of 2-pyrrolidone of the formula:

$$-[NH-CH_2-CH_2-CH_2-CO]_n-$$

wherein $n$ is sufficiently large to give a molecular weight of 8,500 to 500,000 or greater. The extreme porosity of the compressed mass coupled with its gas, liquid and solids adsorptive property renders it superior to present crimped fibrous cigarette filter elements.

2 Claims, No Drawings

NON FIBROUS CIGARETTE FILTER

BACKGROUND OF THE INVENTION

At present various types of crimped cut fibers of cellulose, cellulose acetate and other resin fibers either alone or combined in at least one case with activated charcoal are used in cigarette filters. In order that the pressure drop be not excessive requiring the smoker to "pull" on his cigarette this filter must not be too compact or dense. On the other hand it cannot be too loose or the filtering efficiency is lost.

The labyrinth of passageways in the present cellulose acetate filter elements traps a good deal of the tars and nicotine stemning from the cigarette smoke passing therethrough. But gases generated by the complete or incomplete combustion at the tip of the cigarette such as $CO_2$ gas in the former instance and carbon monoxide in the latter case are passed through in large amounts to be inhaled by the smoker. An ideal form of filter material is one which would not only trap the solid particles resulting from combustion of the tobacco and paper but also some of the gaseous by-products of that combustion such as carbon monoxide.

It is an object of this invention to describe a cigarette filter which (a) traps tars and other solid particles (b) adsorbs some of the combustion product gases such as carbon monoxide (c) partially absorbs moisture (d) does not itself burn and (e) has a moderately rigid foraminous structure. These and other objects of the invention will be more fully described hereinbelow.

BRIEF DESCRIPTION OF THE INVENTION

Accordingly a novel non woven synthetic resinous cigarette filter porous sponge is described which not only entraps tars, resins and nicotine particles more efficiently than heretofore believed possible but also possesses a large gaseous absorptive capacity. The filter comprises a partially polymerized resin of the formula $$-[NH-CH_2-CH_2-CH_2-CO]_n-$$

wherein $n$ is sufficient to constitute a prepolymer of a viscosity of at least 8,500 units. The polymer is referred to as polypyrrolidone. The chemical nature of this resin sponge is such that it adsorbs gases such as nitrogen, $CO_2$, CO and $SO_2$ as a prepolymer at room temperature i.e. about 33° C or 98° F to further polymerize or chain extend its polymer network.

The present discovery employs the non woven particles or pulp of the activated polypyrrolidone resin in a type of semi rigid sponge which permits smoke to pass through but screens out a large amount of the harmful solid particles as well as the carbon monoxide gas generated by the incomplete combustion of the cigarette paper and tobacco. The fact that 2-pyrrolidone monomer is catalyzed to polypyrrolidone polymer by means of an alkaline catalyst such as sodium or potassium hydroxide activated and chin extended by CO or $CO_2$ or $SO_2$ gas working by contact and adsorption on the monomer or prepolymer is the key to my discovery. The same CO or $CO_2$ gas which lengthens the chains of the prepolymer must do so by contact and adsorption of some duration on the polymer. In other words the catalyst activator i.e. gaseous CO or $CO_2$ is itself tied up by the prepolymer with the result that the prepolymer in the filter grows by contact with the $CO_2$ or CO gas to a larger polymer but in this course of events this carbonaceous gas is removed from inhalation by the smoker of the cigarette. The more fully polymerized resin in the filter is discarded after smoking.

In contrast to the crimped tow of cellulose acetate or other fibers including polypyrrolidone fibers known to the art in U.S. Pat. No. 3,119,396 the non woven article of the present invention exerts a physiochemical influence on the combustion products of cigarette smoking to filter not only harmful solids from the cigarette smoke but also some of the potentially harmful gases.

The filter elements employed are manufactured by the drying in a mold under pressure or suction a mass of polypyrrolidone particles which have been expanded with formic or acetic acid in a dilute aqueous solution. Since the polypyrrolidone polymer particles imbibe aqueous acetic acid without dissolution this solution is ideal to create the basis for self bonding. Unlike formic acid the acetic acid does not dissolve the prepolymer particles. Unlike water the acetic acid solution conditions the non woven fabric material for its later contact with $CO_2$ and CO gases passing therein as the polymer is activated and partially polymerized.

As the polymer goes from a low molecular weight to a higher viscosity and higher molecular weight it absorbs $CO_2$ and CO and becomes harder and eventually becomes intractable. This can be shown by the following example of manufacturing of the filter elements of the present invention.

EXAMPLE 1

A 10% solution of polypyrrolidone in acetic acid (the polypyrrolidone is manufactured by either the method described in Barnes U.S. Pat. No. 3,721,652 or Taber U.S. Pat. No. 3,174,951 both incorporated by reference herein) and having an inherent viscosity of less than 3.5 deciliters/gram measured at 30° C as a solution in anhydrous hexafluoro isopropanol can be mixed with dilute NaOH and a white precipitate will be obtained. This is a prepolymer having a low molecular weight of 8,500–12,000 which can be increased to 100,000 by contact with $CO_2$ or CO gases since residual catalyst remains on the prepolymer to act as a primary catalyst. After washing with a 10% solution of acetic acid the swollen particles are dried on a 100 mesh screen in the form of a cylinder mold with pores at one end and the mold pressure held at 1,500 pounds per square inch for 10 minutes at 140° C to form a pulp cylinder which is rigid yet porous and capable of passage of gaseous vapors therethrough.

Tests of this material when affixed as a filter of ½ inch to ⅝ in length will show a much reduced passage of tars, nicotine and CO and $CO_2$ gases therethrough. The filter element is taped to the end of the cigarette as it is manufactured by conventional and known techniques of cigarette manufacturing.

I claim as my invention:

1. A method for manufacture of a cigarette filter which comprises expanding a mass of non fibrous pulp of polypyrrolidone by contact with a solution of acetic acid and drying the expanded mass of pulp to form a self bonded filter body having a large internal surface area and high porosity.

2. A porous smoke filter for absorption of tars, nicotine and combustion gases from tobacco smoke which comprises a self bonded mass of compressed dried and expanded non fibrous particles of a polymer of 2-pyrrolidone wherein the 2-pyrrolidone polymer particles have been expanded by contact with an aqueous acetic acid solution.

* * * * *